US005123709A

United States Patent [19]

Pennington

[11] Patent Number: 5,123,709

[45] Date of Patent: Jun. 23, 1992

[54] HYDRAULIC ALIGNER DEVICE FOR FLEXIBLE CONTINUOUS TRAM MINING MACHINE

[75] Inventor: John H. Pennington, Green River, Wyo.

[73] Assignee: General Chemical Corp., Parsippany, N.J.

[21] Appl. No.: 600,006

[22] Filed: Oct. 17, 1990

[51] Int. Cl.[5] ..... E21F 13/08

[52] U.S. Cl. ..... 299/64; 198/309; 198/861.1

[58] Field of Search ..... 299/18, 31, 64, 67, 299/43; 198/588, 860.1, 861.1, 861.2, 309

[56] References Cited

U.S. PATENT DOCUMENTS

| | | | |
|---|---|---|---|
| 3,612,257 | 10/1971 | Goergen | 198/830 X |
| 4,139,087 | 2/1979 | Westhoff et al. | 198/309 |
| 4,240,665 | 12/1980 | Hubbard et al. | 299/64 X |

FOREIGN PATENT DOCUMENTS

| | | | |
|---|---|---|---|
| 3431412 | 3/1986 | Fed. Rep. of Germany | 299/64 |
| 3723641 | 10/1988 | Fed. Rep. of Germany | 299/64 |
| 2167103 | 5/1986 | United Kingdom | 299/43 |

*Primary Examiner*—David J. Bagnell
*Attorney, Agent, or Firm*—Brumbaugh, Graves, Donohue & Raymond

[57] ABSTRACT

A moveable hydraulic aligner device, particularly suited for aligning a roadway used with a full continuous tram mining machine following a drilling cycle, comprises an upper portion, supported by wheels which allow the device to ride along the length of the roadway, to which two side portions are attached. Each of the side portions supports an extendable hydraulic cylinder which pushes against the rib of a mine tunnel to force the roadway back to the center.

4 Claims, 2 Drawing Sheets

HYDRAULIC ALIGNER DEVICE FOR FLEXIBLE CONTINUOUS TRAM MINING MACHINE

BACKGROUND OF THE INVENTION

In mining operation, an FCT (flexible continuous tram mining machine) is used in combination with a moveable elevated roadway to transport material out of the mine. A roadway, along which the FCT travels, is elevated about 4 feet off the ground and is about 480 feet long. Use of this equipment is organized into drilling cycles. A drilling cycle consists of 6 cuts, 3 on the left and 3 on the right made by a bore miner. Following each drilling cycle the equipment is moved back a distance of about 80 feet and a new drilling cycle is begun.

During movement of the equipment between drilling cycles, the roadway tends to become misaligned. Therefore it is generally necessary to realign the roadway, back to center, before beginning a new drilling cycle. Previous methods employed for realigning the roadway sometimes took up to 12 hours and tended to tear up the roadway.

SUMMARY OF THE INVENTION

The present invention relates to a hydraulic device which is used to align the roadway following movement after a drilling cycle. The device is constructed so as to slide along the roadway and comprises two hydraulic cylinders which contact the bottom of the roadway on either side and are extendable so as to push against the ribs or sides of the mine tunnel, thereby pushing the roadway back to center.

FIG. *2a* is a top view of a hydraulic aligner device according to the present invention;

FIG. *2b* is a perspective view of a hydraulic aligner device with a hose arrangement for providing hydraulic power.

DESCRIPTION OF A PREFERRED EMBODIMENT

Figure 1:
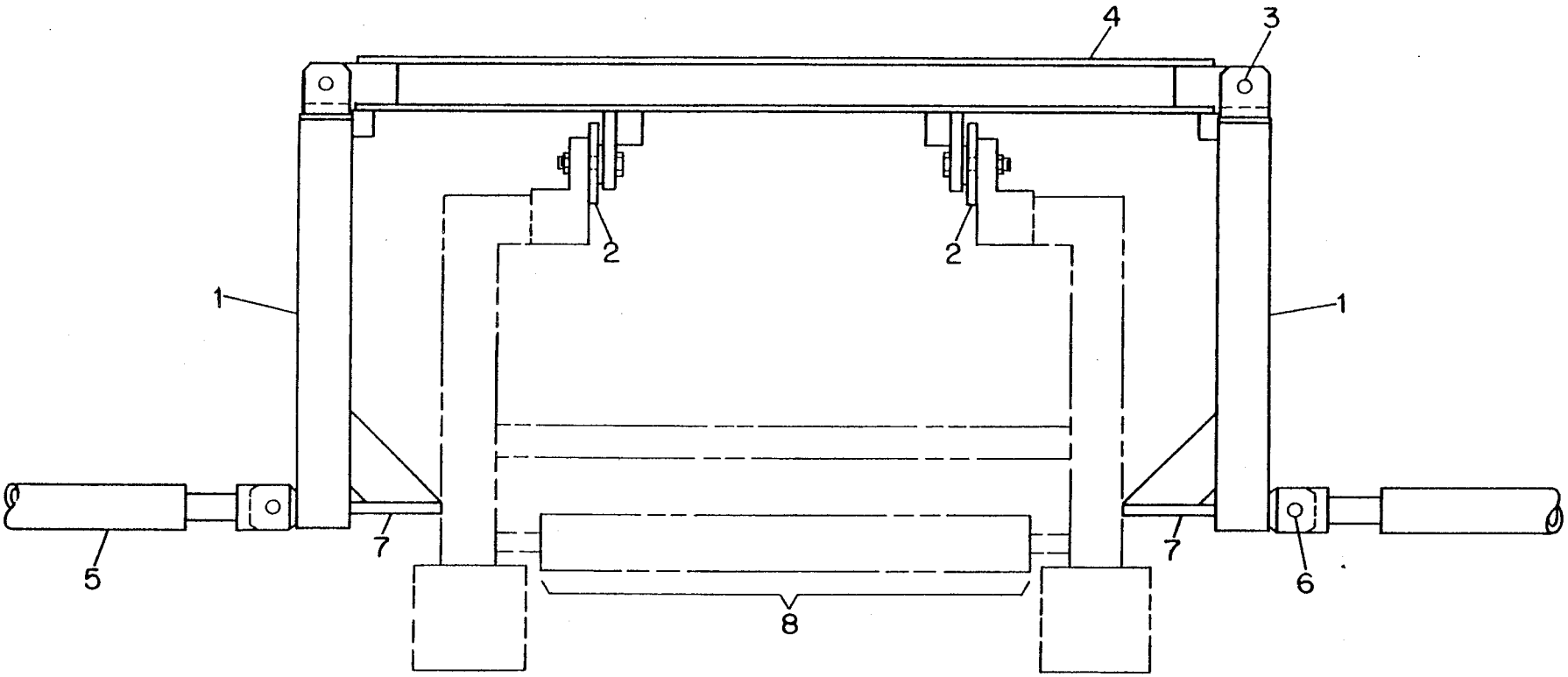
FIG. 1 is a hydraulic aligner device, according to the present invention, in place on an elevated roadway.

Referring to FIGS. 1 and 2 a preferred embodiment of a hydraulic aligner device according to the present invention will be described.

In FIG. 1 a hydraulic aligner device is depicted in place on an elevated roadway 8. An elongated upper portion 4 has wheels 2 symmetrically attached to the underside of the elongated upper portion which supports the hydraulic aligner and allow the entire device to ride along the length of the roadway and support the device. Two side portions 1 are connected on either end of the elongated upper portion 4 by a hinge 3. The side portions extend downward along the sides of the elevated roadway and are constructed with a bracing member 7 which provides contact with either side of the roadway. Hydraulic cylinders 5 are connected at the bottom of each side portion 1 by a foldable hinge 6. The bracing member 7 is located to provide a contact point which is on the axis of hydraulic cylinder 5 when positioned perpendicular to side portion 1. This configuration is best since it focuses the realigning pressure in line with the cylinder and does not create stress in the side portions which would arise from providing a contact point which is not directly across from the cylinder.

FIG. *2a* shows a top view of the hydraulic aligner device described above. In this figure, the hydraulic cylinders are folded up parallel to the side portions.

FIG. *2b* depicts a hose arrangement for a hydraulic aligner device according to the present invention. Each hydraulic cylinder is equipped with extension and retraction fittings. Each of these fittings is connected, through a hose 13 or 14, to an extension hose tee 11 or a retraction hose tee 12. These hose tees are in turn connected to the FCT steering pump, which supplies the hydraulics in this embodiment. This connection is provided by two piece hoses 15 and 16. Two piece hoses 15 and 16 are advantageously separable by a quick disconnect means. This feature is very useful because it provides means for easy access to different hydraulic sources. In this embodiment, direct connection to the FCT steering pump is had through additional hose tees 17 and 18.

Figure 2B:
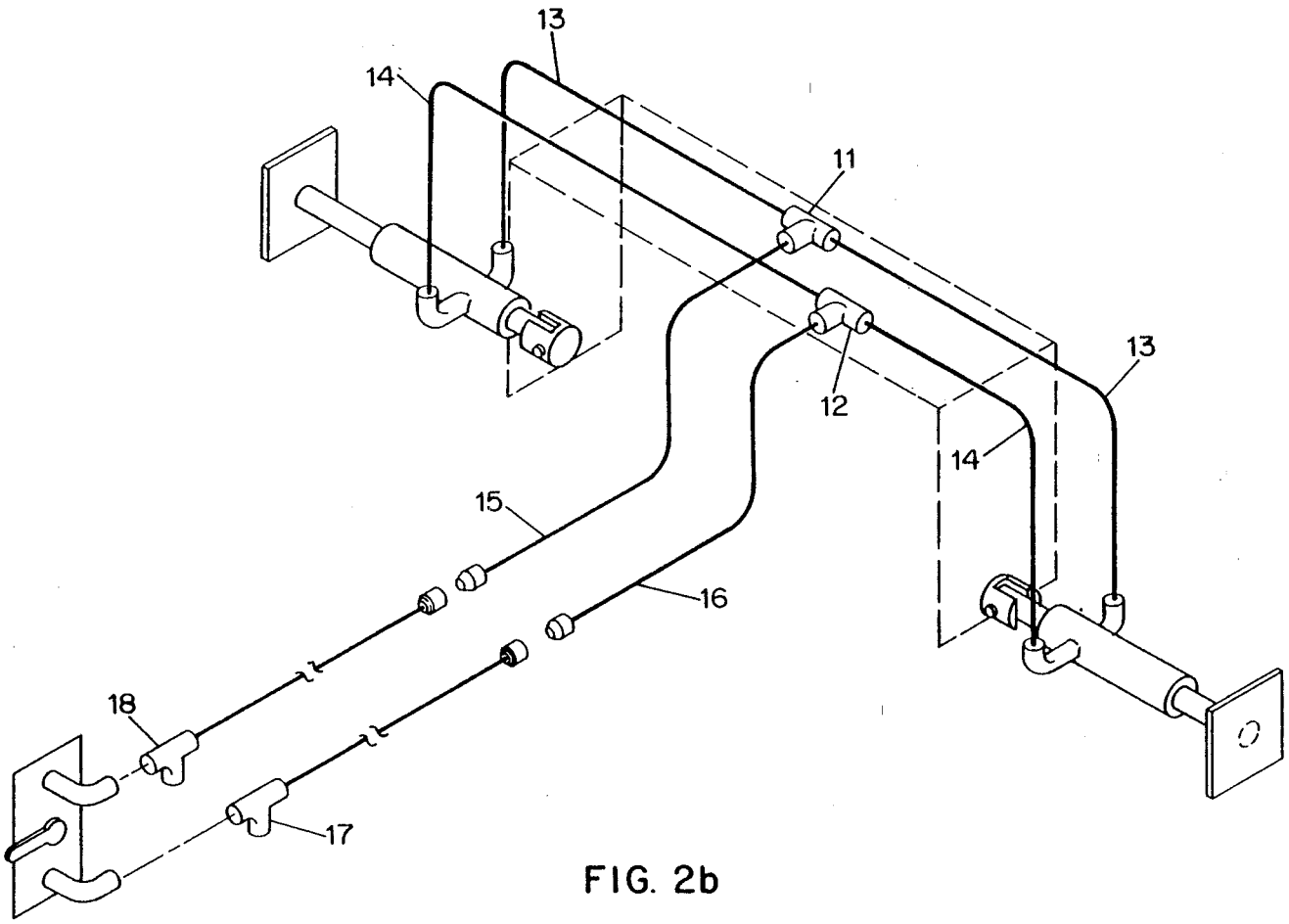
Figure 2A:
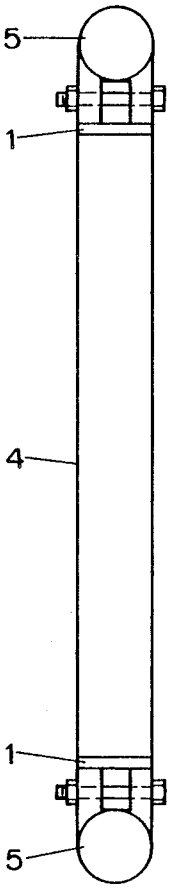

During mining operation, the aligner sits on the roadway with the hydraulic cylinders folded in the vertical up-position (as in FIG. 2A). Then, after the drilling cycle the equipment is moved and the aligner is put into operation in order to center the roadway. The aligner is placed at an end of the roadway which has a ramp upon which the FCT can tram and the hydraulic cylinders are lowered into the horizontal down-position (FIGS. 1 and 2B). The extension tee is then opened causing both cylinders to extend and press against opposing walls of the mine tunnel, thus centering that portion of the roadway. The hydraulic cylinders are then retracted by closing the extension tee and opening the retraction tee, and folded back up. The aligner is then repositioned, usually about 10–20 feet towards the opposite side of the roadway and the process repeated until the whole roadway is aligned.

While there has been described what are believed to be preferred embodiments of the present invention, those skilled in the art will recognize that modifications, to what has been specifically described, can be made without exceeding the scope of this invention which is intended to claim all such changes and modifications or the like.

I claim:

1. A movable hydraulic aligner device for centering an elevated roadway comprising:

an elongated upper portion having a length equal to or slightly greater than the outside width of the roadway;

two wheels symmetrical attached to the under side of said upper portion, spaced so as to allow said hydraulic aligner device to travel on said roadway;

two side portions, first ends of said side portion being attached at opposing ends of said upper portion at a substantially 90° angle such that the side portions extend down along either the side of said roadway, when the wheels are placed on the roadway, each of said side portions including a bracing member disposed between the side portion and the side of the roadway;

two hydraulic cylinders, each attached to one of said side portions and foldable from a position substantially parallel to said side portions to a position substantially perpendicular to said side portions; and means for controlling the length of the hydraulic cylinders.

2. A hydraulic aligner according to claim 1, wherein a pad is provided at the end of said hydraulic cylinders opposite said attachment to said side portions.

3. A hydraulic aligner according to claim 1 or claim 2 wherein said means for controlling the length of the hydraulic cylinders is an FCT steering pump.

4. A hydraulic aligner according to claim 3, additionally comprising:

an extension fitting on each of said hydraulic cylinders;

a retraction fitting on each of said hydraulic cylinders;

an extension hose tea on said upper portion;

a retraction hose tee on said upper portion;

two hoses for connecting said extension hose tee with each of said extension fittings;

two hoses for connecting said retraction hose tee with each of said retraction fittings;

a two piece hose for connecting said extension hose tee with said FCT steering pump through another hose tee, said two piece hose being separable by means of a quick disconnect; and a two piece hose for connecting said retraction hose tee with said FCT steering pump through another hose tee, said hose being separable by means of a quick disconnect.

* * * * *